US009028742B2

(12) United States Patent
Dou

(10) Patent No.: US 9,028,742 B2
(45) Date of Patent: May 12, 2015

(54) STEEL WIRE TEMPERING LIQUID WIPING DEVICE

(75) Inventor: Yong Dou, Weifang (CN)

(73) Assignee: Shan Dong Daye Co., Ltd, Weifang, Shandong (CN)

( * ) Notice: Subject to any disclaimer, the term of this patent is extended or adjusted under 35 U.S.C. 154(b) by 110 days.

(21) Appl. No.: 13/978,405

(22) PCT Filed: Dec. 26, 2011

(86) PCT No.: PCT/CN2011/084705

§ 371 (c)(1),
(2), (4) Date: Jul. 5, 2013

(87) PCT Pub. No.: WO2013/097081

PCT Pub. Date: Jul. 4, 2013

(65) Prior Publication Data

US 2013/0277897 A1 Oct. 24, 2013

(51) Int. Cl.
*C21D 9/52* (2006.01)
*C21D 9/56* (2006.01)

(52) U.S. Cl.
CPC ..... *C21D 9/525* (2013.01); *C21D 9/562* (2013.01); *C21D 9/565* (2013.01)

(58) Field of Classification Search
CPC ..... C21D 9/52; C21D 9/562
USPC ..... 266/120
See application file for complete search history.

(56) References Cited

U.S. PATENT DOCUMENTS

| | | | | | |
|---|---|---|---|---|---|
| 1,875,084 | A * | 8/1932 | McGinnis | ..... | 118/109 |
| 2,178,912 | A * | 11/1939 | Leahey | ..... | 451/313 |
| 2,434,565 | A * | 1/1948 | Hill et al. | ..... | 118/125 |
| 2,657,414 | A * | 11/1953 | Miller et al. | ..... | 15/220.4 |
| 2013/0277879 | A1 * | 10/2013 | Pitts et al. | ..... | 264/162 |

* cited by examiner

*Primary Examiner* — Scott Kastler

(57) ABSTRACT

The present invention discloses a steel wire tempering liquid wiping device. The device comprises a shell. A thermal insulation layer is provided on an inner wall of the shell, and a steel wire inlet and a steel wire outlet are provided on the shell. A wiping fiber rack is installed in a wiping cavity, and a tempering liquid wiping fiber is installed on the wiping fiber rack and is high temperature resistant fibers. After tempering, the steel wires pass through the tempering liquid wiping fiber. At the bottom of the wiping fiber rack, a tempering liquid recovery device is arranged. A heating device is installed in the shell. The steel wires come out from a high temperature tempering furnace, and then enter the steel wire tempering liquid wiping device.

6 Claims, 1 Drawing Sheet

STEEL WIRE TEMPERING LIQUID WIPING DEVICE

CROSS-REFERENCE TO RELATED APPLICATIONS

This application is the U.S. national phase of International Application No. PCT/CN2011/084705, filed on 26 Dec. 2011, the entire contents of which is hereby incorporated by reference.

BACKGROUND OF THE INVENTION

1. Field of the Invention

The present invention relates to a device for processing surface of steel wire, and more particularly to a device for removing tempering liquid for use after tempering steel wire.

2. Background of the Invention

The tire bead steel wire has high strength, good toughness, excellent fatigue properties and good linearity, is primarily used in the tire edge as a reinforcing skeleton material, and is generally formed by drawing high carbon steel wire rod. To further improve the rust resistance, heat aging resistance, and binding force between rubber, the tire bead steel wire is a bronze-plated steel wire. Prior to plating, the surface of the steel wire usually requires a plating treatment. The surface treatment prior to plating is indeed of particularly importance, in which it is required to remove the stress of steel wire by tempering and treat the surface of steel wire by rinsing. The cleanliness of the surface treatment for the tire bead steel wire determine the quality of the plating layer.

In the current manufacturing of tire bead steel wire, in order to remove the stress in the steel wire, a high temperature lead pot tempering is mostly used in the heat treatment procedure. However, the lead used in such a tempering is volatile, which not only causes air pollution, but also is harmful to the operator's health. Meanwhile, during tempering, the steel wire tends to bring the lead in the furnace to the following rinsing procedure, and causes pollution to the rinsing procedure. Since the lead bath tempering has a very high cost, a technique appears in which a high temperature molten sodium hydroxide alkali liquor replaces the high temperature lead liquor during tempering of steel wire. The cost of sodium hydroxide is much lower than that of lead. However, during tempering, sodium hydroxide tends to attach to the surface of steel wire, and at the end of tempering, the sodium hydroxide molten liquid on the steel wire will condense on the steel wire and will be brought to the following rinsing procedure, so that the consumption of sodium hydroxide increases. Besides, since it is impossible to recover the sodium hydroxide which attaches to the surface of steel wire, this not only causes the waste of sodium hydroxide, but also influences the cleaning effect in the following rinsing procedure, which is also one of the important reasons for which this kind of tempering process can not be promoted. In case a conventional wiping tool is used, as the temperature decreases, the alkali liquor on the surface of steel wire will constantly condense on the wiping tool, so that the wiping tool can not be used for a long time. In addition, the common wiping method can not remove the solid state sodium hydroxide which attaches to the surface of steel wire.

BRIEF SUMMARY OF THE INVENTION

The technical problem to be solved by the present invention is to provide a steel wire tempering liquid wiping device which is capable of efficiently removing attachments on the surface of steel wire.

In order to solve the above technical problem, the present invention proposes a technical solution which is a steel wire tempering liquid wiping device which comprises a shell, wherein a thermal insulation layer is fixedly provided on an inner wall of the shell, the shell contains a wiping cavity, a steel wire inlet and a steel wire outlet are provided on the wall of the shell via which the steel wire after tempering passes through the wiping cavity, a wiping fiber rack is installed in the wiping cavity, crumby tempering liquid wiping fiber is installed on the wiping fiber rack, the tempering liquid wiping fiber is a high temperature resistant fiber, the steel wires pass through the tempering liquid wiping fiber after tempering, at the bottom of the wiping fiber rack a tempering liquid recovery device is arranged, and a heating device is installed in the shell.

In a preferred embodiment, the tempering liquid wiping fiber is selected from the group consisting of high temperature resistant carbon fiber, quartz glass fiber, high silica glass fiber, alumina silicate fiber, or combination thereof.

In a preferred embodiment, the tempering liquid wiping fiber has a softening temperature ≥650° C.

In a preferred embodiment, the tempering liquid is a sodium hydroxide molten liquid.

In a preferred embodiment, the thermal insulation layer comprises a heat insulation layer on the inner wall of the shell, and a heat resistant layer is provided on an inner wall of the heat insulation layer.

In a preferred embodiment, the wiping fiber rack comprises at least two sub-racks for accommodating the tempering liquid wiping fiber, and the tempering liquid wiping fiber is arranged in the sub-racks.

In a preferred embodiment, the heating device comprises heating wires which are arranged to surround the wiping fiber rack.

In a preferred embodiment, the alkali liquor recovery device comprises a liquor receiver arranged under the wiping fiber rack, and a tempering liquid outlet communicating with the liquor receiver is provided on the wall of the shell.

Since the above technical solution is adopted, the steel wire tempering liquid wiping device comprises a shell, wherein a thermal insulation layer is fixedly provided on an inner wall of the shell, the shell contains a wiping cavity, a steel wire inlet and a steel wire outlet are provided on the wall of the shell via which the steel wire after tempering passes through the wiping cavity, a wiping fiber rack is installed in the wiping cavity, crumby tempering liquid wiping fiber is installed on the wiping fiber rack, the tempering liquid wiping fiber is a high temperature resistant fiber, the steel wires pass through the tempering liquid wiping fiber after tempering, at the bottom of the wiping fiber rack a tempering liquid recovery device is arranged, and a heating device is installed in the shell. The steel wires come out from a high temperature tempering furnace, and then enter the steel wire tempering liquid wiping device. Under the action of the heating device, temperature in the wiping cavity can guarantee that sodium hydroxide on the surface of the steel wire is always in a liquid state. After the steel wires pass through the tempering liquid wiping fiber, sodium hydroxide in the liquid state is wiped off and flows into an alkali liquor recovery device. Alkali liquor brought out from the tempering furnace by the steel wires is recovered, which not only enables to avoid the waste of alkali liquor, but also prevents the steel wires from bringing the alkali liquor to a subsequent rinsing procedure, thus influencing the cleaning effect of the steel wires in subsequent procedures.

LIST OF REFERENCE NUMERALS

1: shell;
2: heat insulation layer;
3: heat resistant layer;
4: heating wire;
5: wiping cavity;
6: tempering liquid wiping fiber;
7: liquor receiver;
8: tempering liquid outlet;
9: steel wire inlet;
10: steel wire outlet;
11: thermocouple; and
12: wiping fiber rack.

DETAILED DESCRIPTION OF THE INVENTION

The present invention will be further described with reference to the accompanying drawings and embodiments. In the following detailed description, some exemplary embodiments of the present invention are described only by way of illustration. It is apparent for the ordinary skilled in the art that modifications can be made in various manner to the embodiments as described above without departing from the spirit and scope of the present invention. Thus, the accompanying drawings and description are illustrative in nature, instead of limiting the protection scope of the claims.

Figure 1:
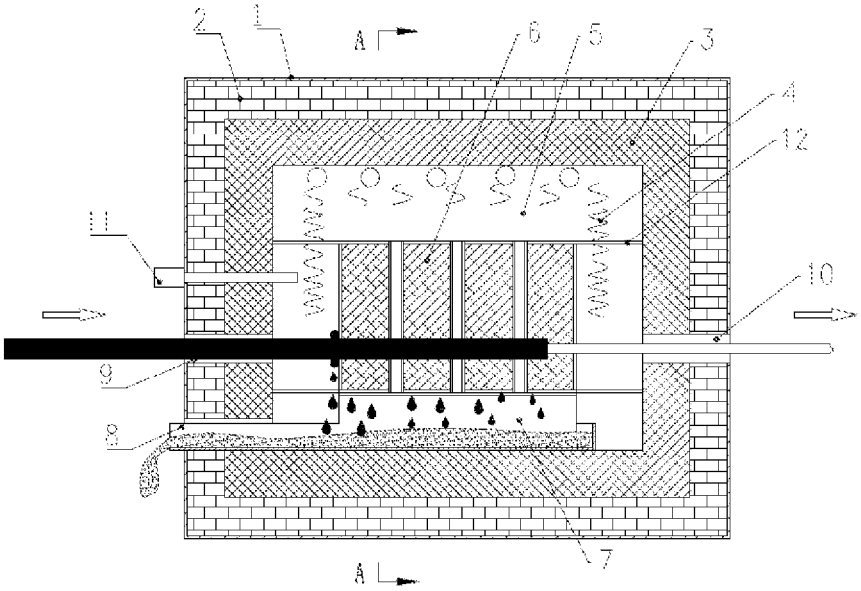
FIG. 1 is a structural diagram of an embodiment of the present invention.
Figure 2:
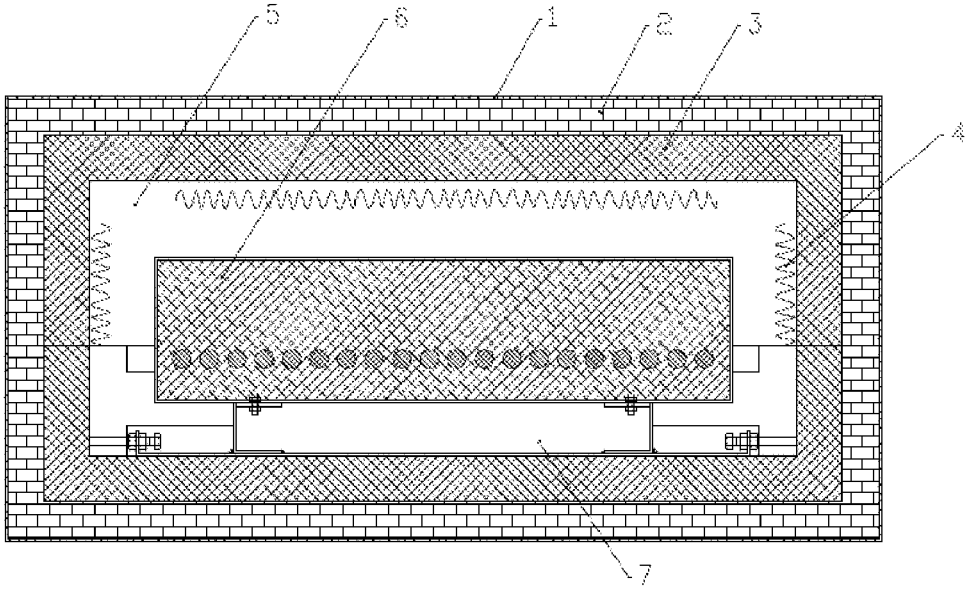
FIG. 2 is a cross sectional view along A-A in FIG. 1.

As shown in FIGS. 1 and 2, a steel wire tempering liquid wiping device comprises a shell 1. A thermal insulation layer is provided on an inner wall of the shell 1. The thermal insulation layer comprises a heat insulation layer 2 which directly adjoins to the inner wall of the shell 1, and a heat resistant layer 3 is arranged on the heat insulation layer 2. The shell 1 contains a wiping cavity 5. A steel wire inlet 9 and a steel wire outlet 10 are provided on the wall of the shell 1 via which the steel wire after tempering passes through the wiping cavity 5. The number of the pair of steel wire outlet 10 and steel wire inlet 9 can be determined as required. In the embodiment shown in FIG. 2, there are 20 pairs of steel wire inlet 9 and steel wire outlet 10. The tempering liquid is a sodium hydroxide molten liquid, namely, the tempering liquid is an alkali liquor in a high temperature molten state. A wiping fiber rack 12 is installed in the wiping cavity 5, crumby tempering liquid wiping fiber 6 is installed on the wiping fiber rack 12, and the tempering liquid wiping fiber 6 is a high temperature resistant fiber. The steel wire passes through the tempering liquid wiping fiber 6 after tempering. The tempering liquid wiping fiber 6 has a softening temperature ≥650° C. The tempering liquid wiping fiber 6 is selected from the group consisting of high temperature resistant carbon fiber, quartz glass fiber, high silica glass fiber, alumina silicate fiber, or combination thereof. The wiping fiber rack 12 comprises at least two sub-racks for accommodating the tempering liquid wiping fiber 6, and the tempering liquid wiping fiber is arranged in the sub-rack 6. As shown in FIG. 1, the number of tempering liquid wiping fibers 6 can be determined as required. In the present embodiment. there are four wiping fiber racks 12, in which four tempering liquid wiping fibers 6 are installed. When the steel wire passes through the tempering liquid wiping fiber 6, the wiping fiber rack 12 can guarantee that tempering liquid wiping fiber 6 should not be brought away from the original location by the steel wire and thus deform.

A heating device is arranged to surround the wiping fiber rack 12, and the heating device is a heating wire 4. An alkali liquor recovery device is arranged under the wiping fiber rack 12. The alkali liquor recovery device comprises a liquor receiver 7 which is arranged under the wiping fiber rack 12. The liquor receiver 7 discharges the recovered alkali liquor into the steel wire tempering furnace through the tempering liquid outlet 8 which passes through the shell 1 and the thermal insulation layer.

The operating principles follow.

After tempering in the tempering furnace, the steel wire enters the steel wire tempering liquid wiping device. As shown in FIGS. 1 and 2, the steel wire passes through the steel wire inlet 9 and enters the wiping cavity 5. When the steel wire passes through the tempering liquid wiping fiber 6, the alkali liquor attaching to the surface of steel wire is wiped completely by the tempering liquid wiping fiber 6. Once the alkali liquor in the tempering liquid wiping fiber 6 is accumulated to a certain amount, the alkali liquor will drops slowly from the tempering liquid wiping fiber 6 into the liquor receiver 7 under the wiping fiber rack 12. The alkali liquor in the liquor receiver 7 is fed back to the tempering furnace through the tempering liquid outlet 8, so that the alkali liquor brought by the steel wire from the tempering furnace is recovered, thus reducing the cost. The alkali liquor attaching to the surface of steel wire tends to condense and is difficult to wipe. In order to guarantee that the alkali liquor always maintains a liquid state, it is necessary for the wiping cavity 5 to reach a relatively high temperature. To this end, a heating wire 4 is arranged in the wiping cavity 5. Once a thermocouple 11 which is installed on the steel wire tempering liquid wiping device detects that the temperature in the wiping cavity 5 is lower that a preset threshold, the heating wire 4 is activated to heat. Once the temperature in the wiping cavity 5 reaches a required temperature, the heating wire 4 stops heating.

The basic principles, major features, and advantages of the present invention have been shown and described as above. The skilled in the art will recognize that the present invention should not be limited to the above embodiments, and the above embodiments and the detailed description only illustrate the principles of the present invention. Various variations and modifications can be made to the present invention without departing from the spirit and scope thereof. Such variations and modifications fall within the scope of the present invention as claimed. The scope of the present invention is defined in the appended claims and equivalents thereto.

What is claimed is:

1. A steel wire tempering liquid wiping device which comprises a shell, characterized in that: a thermal insulation layer is fixedly provided on an inner wall of the shell, the shell contains a wiping cavity, a steel wire inlet and a steel wire outlet are provided on the wall of the shell via which the steel wire after tempering passes through the wiping cavity, a wiping fiber rack is installed in the wiping cavity, tempering liquid wiping fiber is installed on the wiping fiber rack, the tempering liquid wiping fiber is a high temperature resistant fiber, the steel wires pass through the tempering liquid wiping fiber after tempering, at the bottom of the wiping fiber rack a tempering liquid recovery device is arranged, and a heating device is installed in the shell.

2. The steel wire tempering liquid wiping device of claim 1, characterized in that: the tempering liquid wiping fiber is selected from the group consisting of high temperature resistant carbon fiber, quartz glass fiber, high silica glass fiber, alumina silicate fiber, or combination thereof.

3. The steel wire tempering liquid wiping device of claim 2, characterized in that: the tempering liquid wiping fiber has a softening temperature ≥650° C.

4. The steel wire tempering liquid wiping device of claim 1, characterized in that: the tempering liquid recovery device comprises a liquor receiver arranged under the wiping fiber rack, and a tempering liquid outlet communicating with the liquor receiver is provided on the wall of the shell.

5. The steel wire tempering liquid wiping device of claim 2, characterized in that: the tempering liquid recovery device comprises a liquor receiver arranged under the wiping fiber rack, and a tempering liquid outlet communicating with the liquor receiver is provided on the wall of the shell.

6. The steel wire tempering liquid wiping device of claim 3, characterized in that: the tempering liquid recovery device comprises a liquor receiver arranged under the wiping fiber rack, and a tempering liquid outlet communicating with the liquor receiver is provided on the wall of the shell.

* * * * *